United States Patent [19]

Gaudet

[11] Patent Number: 4,926,662

[45] Date of Patent: May 22, 1990

[54] PADLOCK SHIELD

[76] Inventor: Rolland M. Gaudet, Site 26, Box 26, R. R. #1, Windsor Junction, Halifax Co., Nova Scotia, Canada, B0N 2V0

[21] Appl. No.: 366,395

[22] Filed: Jun. 15, 1989

[51] Int. Cl.[5] ..... E05B 67/58

[52] U.S. Cl. ..... 70/56; 70/159

[58] Field of Search ..... 70/54, 55, 56, 417, 70/418, 158–173

[56] References Cited

U.S. PATENT DOCUMENTS

| | | | |
|---|---|---|---|
| 676,001 | 6/1901 | Jarvis | 70/56 |
| 1,244,404 | 10/1917 | Ankovitz | 70/56 |
| 3,392,555 | 7/1968 | Beaver | 70/56 |
| 3,996,774 | 12/1976 | Best | 70/54 |
| 4,030,321 | 6/1977 | Kenjron | 70/54 |
| 4,033,156 | 7/1977 | Cottingham | 70/56 |

*Primary Examiner*—Robert L. Wolfe

*Attorney, Agent, or Firm*—Gowling, Strathy & Henderson

[57] ABSTRACT

A padlock shield for protecting padlocks from exposure to rain and snow is disclosed. The shield is comprised of a cover which is made up of a plurality of walls, one of which includes a mechanism for accepting a staple therethrough at any one of a plurality of orientations.

6 Claims, 3 Drawing Sheets

PADLOCK SHIELD

BACKGROUND OF THE INVENTION

This invention relates generally to padlock shields and more specifically to shields for protecting padlocks from adverse weather conditions.

SUMMARY OF THE PRIOR ART

A number of shields have been previously proposed for protecting padlocks from damage through exposure to rain and snow. Examples of such protective devices are shown in U.S. Pat. No. 676,001, granted to Jarvis on June 11, 1901; U.S. Pat. No. 1,244,404, granted to Ankovitz on Oct. 23, 1917; and U.S. Pat. No. 4,033,156 granted to Cottingham on July 5, 1977.

While all these protective devices are capable of protecting padlocks from exposure to rain and snow, many of them have a disadvantage in that they are designed to only accept staples which are oriented either in a vertical direction or in a horizontal direction. In the case of the Jarvis or Ankovitz devices, for example, the padlock shields may only be effectively used with staples which are vertically oriented. If the staple is oriented horizontally, rain or snow may enter the open side of the shield and damage the padlock. None of the devices previously disclosed are able to be used in conjunction with staples which have different orientations from that for which the device was manufactured.

SUMMARY OF THE INVENTION

The padlock shield of the present invention comprises a cover having a plurality of walls, one of which is provided with a means for receiving a staple oriented at any one of a plurality of angles.

In a first embodiment of this invention, the means for receiving the staple comprises a cruciform-shaped opening in the wall. As the cover is made from a pliable material, the areas of the wall delimited by the arms of the cross are able to deflect to a certain degree. The staple may be oriented in a vertical position, horizontal position, at 45 degrees to the vertical or 135 degrees to the vertical.

In a second embodiment of the invention, the means for receiving the staple comprises a rotatable wheel mounted in the wall of the cover, said wheel having a staple-receiving slot therein. When the staple is received into the slot, the wheel may be rotated to a degree sufficient to ensure that the shield is disposed to adequately protect the padlock from the elements.

BRIEF DESCRIPTION OF THE DRAWINGS

The preferred embodiments of this invention will now be more fully described with the aid of the following drawings, in which.

DESCRIPTION OF THE INVENTION

Figure 1:
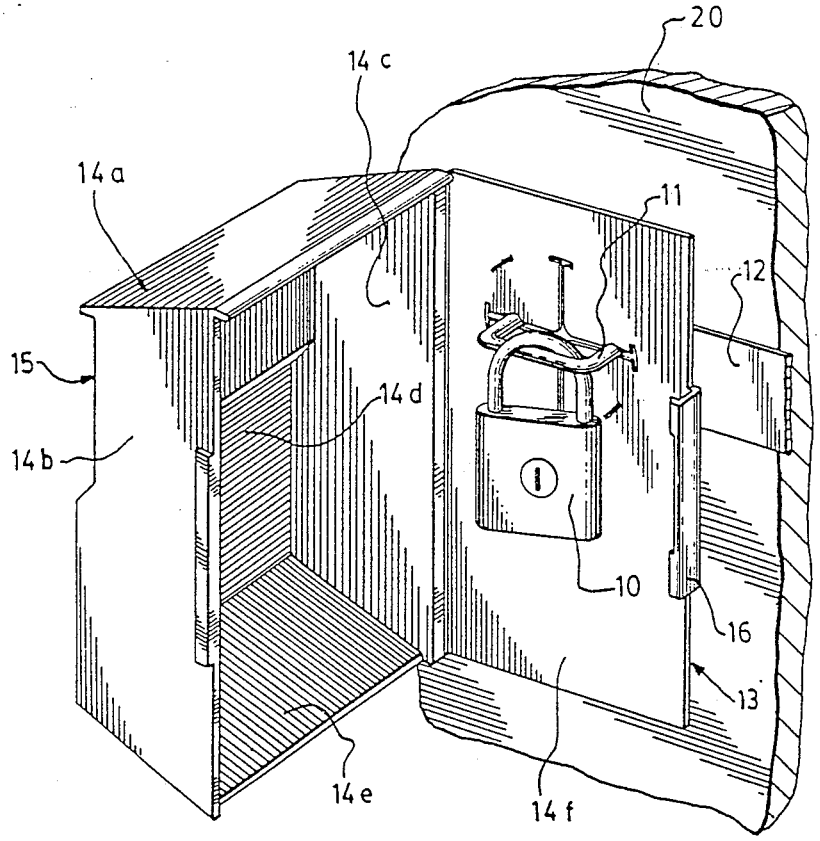
FIG. 1 is a perspective view of a first embodiment of the invention showing a padlock secured to a staple.
Figure 2:
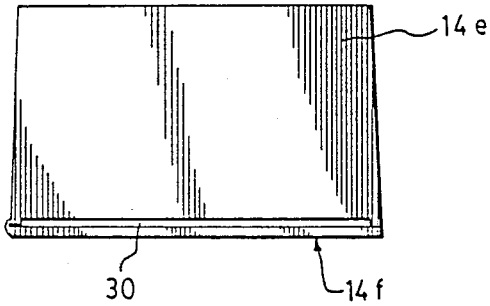
FIG. 2 is a bottom view of the first embodiment of the invention.
Figure 3:
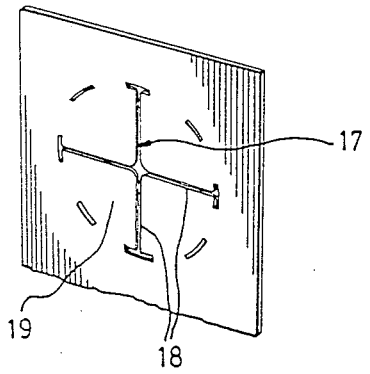
FIG. 3 is a perspective view of the rear wall of the the embodiment of the invention shown in FIG. 1 without the padlock and staple.

The shield of the present invention is designed to protect a padlock 10 which is fastened to a staple 11. Referring to FIGS. 1, 2 and 3, there is shown a first embodiment of the invention, used in conjunction with the conventional staple 11/hasp 12 combination which is used to secure doors, gates etc. The cover 13, which may be made from a pliable or resilient material such as plastic, comprises an upper wall 14*a;* two side walls, 14*b*, 14*c;* a front wall 14*d*, a lower wall 14*e* and a rear wall 14*f*. The rear wall 14*f* is hingedly connected to one of the side walls so that the cover 13 is in the form of a rear wall 14*f* and a front portion 15 which may be secured to the rear wall 14*f* by a latch 16. A drainage hole 30 is formed in the lower wall 14*e*, as shown in FIG. 2, to allow any condensed moisture to drain from the cover 13.

The rear wall 14*f* has a cruciform-shaped opening 17 for receiving the staple 11 therethrough. The arms 18 of the opening 17 delimit areas 19 therebetween. The areas 19 are sufficiently deformable so that the opening 17 can receive the staple 11 either vertically, horizontally, or at an angle of 45 degrees or 135 degrees to the vertical. This means that a staple 11 fixed to a surface 20 in any one of these aforementioned orientations can be received into the rear wall 14*f* of the cover 13 and may be there be secured by a padlock 10.

It will be understood by those skilled in the art that it is possible to manufacture the padlock shield with any shape of opening 17 which will allow the shield to receive a staple 11 at any one of a plurality of orientations, or to manufacture the shield with any number of arms 18. The shield is also made of a sufficiently resilient material which will allow a user to either enlarge one of the arms 18 of the opening 17, or to cut a new arm at a different angle to receive a staple which cannot be accommodated by the padlock shield as disclosed above.

The cover 13 is not permanently attached to the surface 20, or to the staple 11 or the hasp 12, but is rather held and locked in position by the padlock 10 being secured to the staple 11. When the padlock 10 is removed, the cover 13 does not remain in position.

The first embodiment of the invention is used in the following manner. The hasp 12 (if present) is positioned over the staple 11. The rear wall 14*f* of the cover 13 is brought into close proximity with the staple 11, which is then forced through the opening 17. Depending on the orientation of the staple, different areas 19 of the rear wall 14*f* will be deformed to accommodate the staple 11. The padlock 10 is then secured to the staple 11 and the front portion 15 of the cover 13 is latched to the rear wall 14*f* by the latch 16. When the user wishes to gain access to the premises secured by the padlock 10, he simply opens the front portion 15 of the cover, unlocks the padlock 10 and removes the same from the staple 11.

Figure 4:
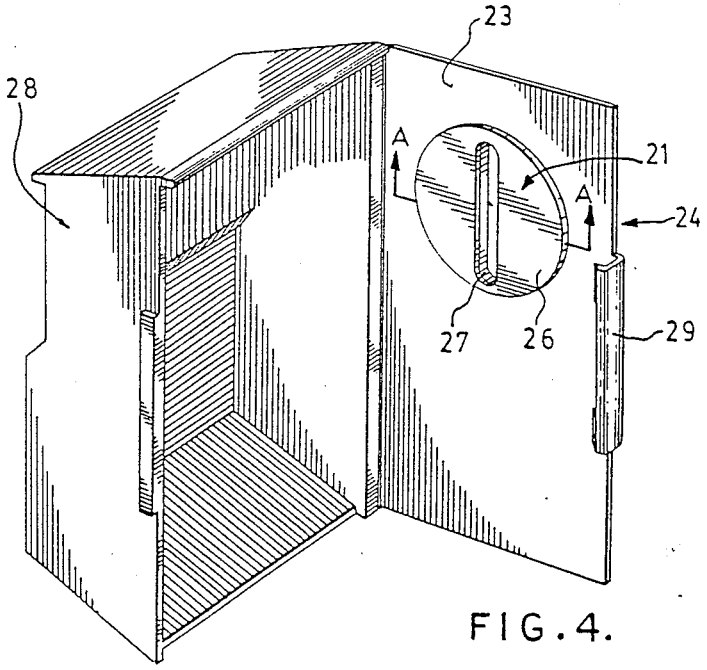
FIG. 4 is a perspective view of a second embodiment of the invention.
Figure 5:
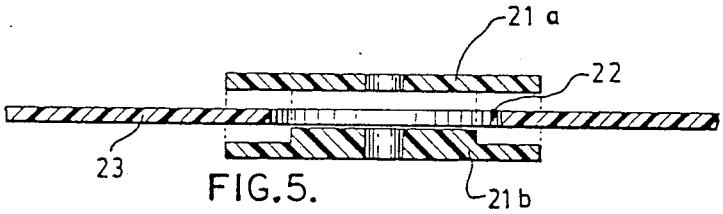
FIG. 5 is an exploded side view through line A—A of FIG. 4.

A second embodiment of the invention is shown in FIG. 4. In this embodiment, a rotatable wheel 21 is secured into a hole 22 in the rear wall 23 of the cover 24. The rotatable wheel 21 has an upper portion 21*a* and lower portion 21*b*. As shown in FIG. 5, the upper portion 21*a* and lower portion 21*b* are positioned so that they lie on opposite sides of the rear wall 23. The upper portion 21*a* and lower portion 21*b* may then be glued together or joined together by other suitable means. The wheel 21 has a staple-receiving slot 27 through which the staple (not shown) may be passed.

The second embodiment of the invention is used in the following manner. The wheel 21 is rotated to align with the staple. The rear wall 23 of the cover 24 is brought into close proximity to the staple which is then received through the slot 27. The padlock (not shown) is secured to the staple, and the front portion 28 of the cover 24 is secured to the rear wall 23 by a latch 29.

Figure 6:
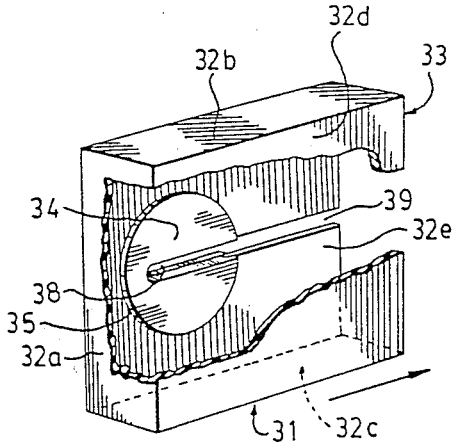
FIG. 6 is a partially cut-away perspective view of a third embodiment of the invention.
Figure 6:
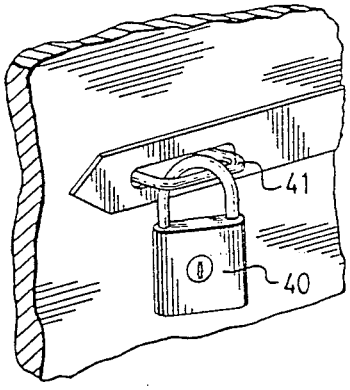

A third embodiment of the invention is shown in FIG. 6. In this embodiment, the cover 31 comprises an upper wall 32*a*, two side walls 32*b*, 32*c*, a front wall 32*d* and a rear wall 32*e*. The cover 31 is open at its base 33 to allow any condensed moisture to drain from the cover 31.

A rotatable wheel 34 is secured into a hole 35 in the rear wall 32*e* of the cover 31 in the same manner as described for the second embodiment of the invention. The wheel 34 has a staple-receiving slot 38 through which a staple may be passed. The rear wall 32*e* also has a groove 39 which begins at the base 33 of the cover and runs substantially parallel to the longitudinal axis of the wall and terminates in the hole 35. The slot 38 in the wheel 34 may be aligned with the groove 39, as is shown in FIG. 6, so that a staple 41 can be drawn through the groove 39 and into the slot 38.

Figure 8:
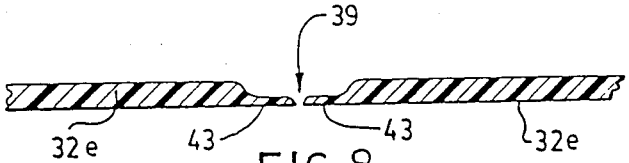
FIG. 8 is a bottom view of the invention through line B—B of FIG. 7.

As is shown in FIG. 8, the rear wall 32*e* in the vicinity of the groove 39 may be formed into lips 43 which partially project over the groove 39. As the padlock shield is manufactured from a resilient material, the lips 43 are bendable and the staple 41 can therefore be forced through the lips 43 and into the groove 39. The lips 43 then return to their original position. The lips 43 aid in preventing rain and snow from readily entering the groove 39 and gaining access to the padlock 40.

Figure 7:
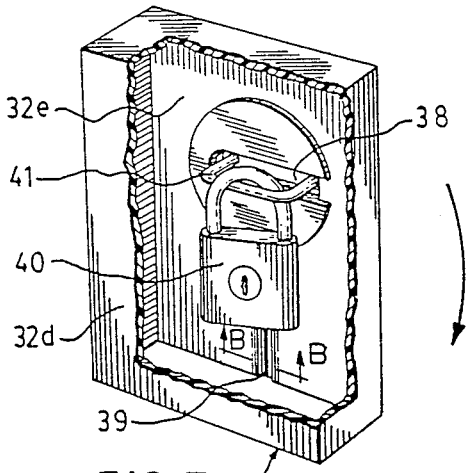
FIG. 7 is a partially cut-away perspective view of the embodiment of the invention shown in FIG. 6, where the cover is rotated to allow the base to open in a direction which will substantially prevent the entrance of snow or rain into the cover.

The third embodiment of the present invention is used in the following manner. For the purposes of this illustration only, the staple will be assumed to lie in a horizontal orientation. Referring to FIG. 6, the padlock 40 is secured to the staple 41. The cover 31 is brought into close proximity with the padlock and staple so that the staple 41 is received within the groove 39. The cover is then moved towards the padlock and staple, so that the padlock and staple is effectively moved towards the upper wall 32*a* of the cover. The staple 41 travels in the groove 39 of the rear wall 32*e* until it is received in the slot 38. At this point, the base 33 of the cover 31 is vertically aligned, thereby permitting rain and snow to enter the cover. The cover 31 is therefore rotated as shown by the arrow in FIG. 7, to the point that the base 33 faces in a direction that permits any condensed moisture to run out of it and which essentially prevents rain and snow from entering the cover with ease. The rotation of the cover does not have to result in the base being horizontally oriented, but may result with the base being inclined at an angle as is shown in FIG. 7.

When the user requires to gain access to the padlock 40, he simply rotates the cover 31 until the slot 38 and groove 39 align, and then slides the cover off the padlock and staple. If the staple is oriented in the vertical position, the cover 31 may be brought into the proximity of the padlock 40 and staple 41 so that the staple 41 enters the groove 39. The cover 31 is then simply moved downwardly toward the padlock and staple until the staple enters the slot 38. There is no need to rotate the cover 31 in this instance.

In the third embodiment of the invention, the padlock 40 is locked into the cover 31 by the rotation of the same, for all orientations of the staple, except vertical.

In all three embodiments of the invention, the cover is held in position by the padlock being secured to the staple. The cover is not attached to any surface, or to the hasp or staple.

Variations in the above invention will be obvious to those skilled in the art and these variations considered to lie within the scope of the present invention.

The embodiments of the invention in which an exclusive property or privilege are claimed is defined as follows:

1. A padlock shield for protecting a padlock when it is secured to a staple, said shield comprising:
   a cover having a plurality of walls, one of which has a means for receiving a staple therethrough, said means being adapted to receive the staple therethrough at any one of a plurality of orientations.

2. A padlock shield as defined in claim 1, wherein the means for receiving the staple therethrough comprises a cruciform shaped opening.

3. A padlock shield as defined in claim 2, wherein the shield is comprised of a pliable or resilient material.

4. A padlock shield as defined in claim 2 or 3 wherein the staple may be received through the opening either vertically, horizontally, at a 45 degree angle to the vertical or at a 135 degree angle to the vertical.

5. A padlock shield as defined in claim 1, wherein the wall which has a means for receiving a staple therethrough has a hole therein, and the means for receiving the staple comprises a wheel having a slot, said wheel being rotatably mounted within the hole in the wall.

6. A padlock shield as defined in claim 5, wherein the walls of the cover form a box which is open at one end, and the wall which has the wheel mounted therein also has a groove which begins at the open end of the box, runs substantially parallel to the longitudinal axis of the wall and terminates in the hole; so that the slot in the wheel may be aligned with the groove and a staple may be moved along the groove and into the slot in the wheel.

* * * * *